US010442594B2

(12) United States Patent
Hallam et al.

(10) Patent No.: US 10,442,594 B2
(45) Date of Patent: Oct. 15, 2019

(54) COMPRESSED TISSUE CARTON WITH TEAR STRIP

(75) Inventors: James Alexander Hallam, London (GB); Dennis Edward Fryer, Ashford (GB); Martin Christopher Bunce, Pewsey (GB); Peter Booth, Savernake (GB); James Mallion, Swindon (GB)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 1721 days.

(21) Appl. No.: 13/040,464

(22) Filed: Mar. 4, 2011

(65) Prior Publication Data

US 2012/0223093 A1 Sep. 6, 2012

(51) Int. Cl.

| | |
|---|---|
| ***A47K 10/24*** | (2006.01) |
| ***B65H 1/00*** | (2006.01) |
| ***B65D 77/04*** | (2006.01) |
| ***B65D 77/32*** | (2006.01) |
| ***B65D 83/08*** | (2006.01) |

(52) U.S. Cl.

CPC ..... *B65D 77/042* (2013.01); *B65D 77/32* (2013.01); *B65D 83/0805* (2013.01)

(58) Field of Classification Search

CPC ... B65D 77/042; B65D 77/32; D65D 83/0805

USPC ..... 221/50, 46, 45, 47, 48, 302, 64, 65; 206/451, 494

See application file for complete search history.

(56) References Cited

U.S. PATENT DOCUMENTS

| | | | | |
|---|---|---|---|---|
| 1,628,981 | A | 5/1927 | Horwitt | |
| 2,672,233 | A | 3/1954 | Baxter | |
| 3,172,563 | A | 3/1965 | Harwood | |
| 3,197,062 | A * | 7/1965 | Day | B65D 5/0005 206/451 |
| 3,239,097 | A | 3/1966 | Bates et al. | |
| 3,263,807 | A * | 8/1966 | Fingerhut | B65D 75/08 229/238 |
| 3,325,003 | A * | 6/1967 | Bilezerian | B65D 65/42 206/205 |
| 3,379,364 | A * | 4/1968 | Pilger | B29C 59/007 229/87.05 |
| 3,576,243 | A | 4/1971 | Trunick | |
| 3,684,086 | A * | 8/1972 | Harrison | B65D 75/5827 206/449 |
| 3,970,215 | A * | 7/1976 | McLaren | A47K 10/421 221/45 |

(Continued)

FOREIGN PATENT DOCUMENTS

| | | | |
|---|---|---|---|
| DE | 1261439 | B | 2/1968 |
| DE | 202007005536 | U1 | 8/2007 |

(Continued)

*Primary Examiner* — Rakesh Kumar

(74) *Attorney, Agent, or Firm* — Kimberly-Clark Worldwide, Inc.

(57) ABSTRACT

Generally, the present disclosure relates to a carton for tissue products comprising a carton and an overwrapped compressed stack of tissues, such as facial tissues. The compressed carton can significantly reduce costs associated with shipping such low density products. The overwrapped compressed stack of tissues has a tear strip, which permits the compressed stack of tissues to expand, releasing the compression of the tissue stack and allowing the tissues to be dispensed normally.

9 Claims, 5 Drawing Sheets

(56) References Cited

U.S. PATENT DOCUMENTS

| | | | | | |
|---|---|---|---|---|---|
| 3,979,019 | A * | 9/1976 | Bliss | B65D 5/4204 | 221/48 |
| 4,790,436 | A * | 12/1988 | Nakamura | B65D 83/0805 | 206/449 |
| 4,836,410 | A * | 6/1989 | Mastrobuoni | B65D 83/0805 | 221/47 |
| 4,944,405 | A * | 7/1990 | Buford | B65D 5/48008 | 229/120.04 |
| 5,016,753 | A | 5/1991 | Henderson | | |
| 5,145,091 | A | 9/1992 | Meyers | | |
| 5,219,421 | A | 6/1993 | Tipping | | |
| 5,507,130 | A | 4/1996 | Young et al. | | |
| 5,535,887 | A | 7/1996 | Young et al. | | |
| 5,540,354 | A | 7/1996 | Annand | | |
| 5,642,602 | A | 7/1997 | Young et al. | | |
| 5,666,786 | A | 9/1997 | Focke et al. | | |
| 5,704,480 | A * | 1/1998 | Scholz | A61F 13/041 | 206/438 |
| 5,857,311 | A | 1/1999 | Focke et al. | | |
| 6,065,591 | A * | 5/2000 | Dill | B65D 83/0805 | 206/233 |
| 6,102,277 | A | 8/2000 | Krapohl, Sr. | | |
| 6,409,044 | B1 | 6/2002 | Brown et al. | | |
| 6,474,542 | B1 * | 11/2002 | Chagnon | B65D 5/4204 | 229/162.3 |
| 6,672,475 | B1 | 1/2004 | Ho et al. | | |
| 6,817,484 | B2 * | 11/2004 | Morin | B65D 83/0894 | 221/48 |
| 7,571,832 | B2 | 8/2009 | Mark et al. | | |
| 7,886,933 | B2 | 2/2011 | Hirasawa et al. | | |
| 8,033,421 | B2 | 10/2011 | Cowell et al. | | |
| 8,205,748 | B2 * | 6/2012 | Long et al. | 206/494 | |
| 8,210,393 | B1 | 7/2012 | Nasrallah | | |
| 2003/0155264 | A1 | 8/2003 | Morin | | |
| 2003/0168467 | A1 | 9/2003 | Thoms | | |
| 2005/0150801 | A1 | 7/2005 | Tippey | | |
| 2005/0269343 | A1 | 12/2005 | Gao et al. | | |
| 2008/0054012 | A1 | 3/2008 | Long | | |
| 2008/0061120 | A1 * | 3/2008 | Nowak | B65B 25/14 | 229/87.05 |
| 2008/0128451 | A1 | 6/2008 | Krauth et al. | | |
| 2008/0257903 | A1 | 10/2008 | Hirasawa et al. | | |
| 2009/0289077 | A1 | 11/2009 | Melin et al. | | |
| 2009/0289078 | A1 | 11/2009 | Melin et al. | | |
| 2010/0078444 | A1 * | 4/2010 | Shannon | B65D 21/086 | 221/63 |
| 2010/0102077 | A1 * | 4/2010 | Szymonski et al. | 221/45 | |
| 2010/0243504 | A1 * | 9/2010 | Long | A47K 10/421 | 206/494 |
| 2011/0129633 | A1 * | 6/2011 | Andersson | B65H 45/101 | 428/43 |

FOREIGN PATENT DOCUMENTS

| | | | |
|---|---|---|---|
| EP | 1607033 | A1 | 12/2005 |
| FR | 2 914 281 | A1 | 10/2008 |
| GB | 2163131 | A | 2/1986 |
| JP | 49-090581 | U | 8/1974 |
| JP | 59-112775 | U | 7/1984 |
| JP | 59-181075 | U | 12/1984 |
| JP | 01-182280 | A | 7/1989 |
| JP | 3009515 | U | 4/1995 |
| JP | 07-315458 | A | 12/1995 |
| JP | 09-140623 | A | 6/1997 |
| JP | 09-140624 | A | 6/1997 |
| JP | 09140623 | A * | 6/1997 |
| JP | 10-290763 | A | 11/1998 |
| JP | 2001340257 | * | 1/2001 |
| JP | 2001-340257 | A | 12/2001 |
| JP | 2002-308352 | A | 10/2002 |
| JP | 2004-026294 | A | 1/2004 |
| JP | 2006-298416 | A | 11/2006 |
| JP | 2009-165763 | A | 7/2009 |
| JP | 2010-047270 | A | 3/2010 |
| KR | 10-2008-0009791 | A | 1/2008 |

* cited by examiner

COMPRESSED TISSUE CARTON WITH TEAR STRIP

FIELD OF THE INVENTION

This disclosure relates to a tissue carton comprising a stack of compressed tissues wrapped in a releasable constraining device which maintains the tissues in a compressed state until released by a user. Various embodiments of compressed tissue stacks and cartons are disclosed. By wrapping the compressed tissues in a releasable constraining device it has been discovered that the tissues may be packed in smaller volume cartons, while allowing users to dispense the tissues normally.

BACKGROUND

When shipping folded tissue products, such as cartons of facial tissues, a significant portion of the transportation costs incurred are due to shipping air because of the low density of the tissues. Consequently, when shipping by truck, for example, the volume capacity of the truck is reached before the weight capacity. Also, on the retailers' shelves, the bulkiness of the tissue products consumes shelf space and therefore limits the number of items the retailers can stock. Unfortunately, placing more tissues into a given carton to increase shipping cost efficiency and/or reduce consumption of retail shelf space creates compression within the stack of tissues and thereby makes it difficult for the user to remove the first few tissues from the carton without tearing them.

While the retailer often desires products which use less shelf space, there are disadvantages to using compressed or concentrated products. For example, one disadvantage is that compressed tissue stacks dispense poorly when packaged in traditional flat tissue cartons. Therefore, there is a need for tissue products that can be shipped more economically without sacrificing ease of dispensing or presence of the product on the retailer's shelf.

SUMMARY

It has now been surprisingly discovered that compressed tissues may be dispensed with ease by packaging the tissues in a releasable constraining device, such as a sleeve or overwrap, and packing the compressed tissues in a carton capable of dispensing the tissues without ripping or tearing. The preferred releasable constraining device comprises a tear strip which the user removes thereby opening the constraining device and creating a dispensing opening through which the tissues may be removed by the user. Preferably, removal of the tear strip creates an opening in the constraining device having a width of from about 30 to 50 mm. Thus, in a preferred embodiment the present disclosure provides a tissue carton for dispensing a compressed stack of tissues comprising one or more panels forming the outer walls of the carton; an opening disposed on at least one panel; and an overwrapped compressed stack of tissues disposed within the carton, the overwrap having a tear strip disposed on its upper surface.

In another embodiment the present disclosure provides a tissue carton for dispensing a compressed stack of tissues comprising a top panel; a pair of opposing side panels; a pair of opposing end panels; a bottom panel; a removable surfboard disposed on the top panel, the surfboard defining a carton opening; an overwrapped stack of compressed tissues having a height $h_2$ disposed within the carton; and a tear strip disposed on the overwrapped stack of compressed; wherein removal of the tear strip causes the compressed stack of tissues to expand to a height $h_3$.

In still other embodiments the present disclosure provides a tissue carton comprising a top panel; a first and a second sidewall; a carton opening disposed on the top panel; a removable surfboard covering at least a portion of the carton opening; and a compressed stack of tissues wrapped in a releasable constraining device having a tear strip disposed within the carton.

In yet other embodiments the present disclosure provides a method of making a carton of compressed tissues comprising the steps of providing a dispensing carton having a top panel and a carton opening disposed thereon; compressing a stack of tissue sheets; wrapping the compressed stack of tissues in a wrapper; and inserting the wrapped compressed stack of tissue sheets into the carton.

DEFINITIONS

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, "tissue" generally refers to various paper products, such as facial tissue, bath tissue, paper towels, napkins, and the like. Normally, the basis weight of a tissue product of the present disclosure is less than about 80 grams per square meter (gsm), in some embodiments less than about 60 gsm, and in some embodiments, between about 10 to about 60 gsm.

As used herein the term "carton opening" generally refers to an opening formed in one or more walls of a carton.

As used herein the term "dispensing opening" generally refers to an opening through which tissues are dispensed such as, for example, an opening formed in a material overwrapping a stack of tissues.

DETAILED DESCRIPTION

Generally, the present disclosure relates to a carton for dispensing compressed tissues. It has been discovered that compressed tissues may be dispensed with ease by packaging the compressed tissues in a releasable constraining device, such as a sleeve or overwrap, and packing the compressed tissues in a carton capable of dispensing the tissues without ripping or tearing. Preferably the releasable constraining device comprises an overwrap material having a tear strip which the user removes to open the device and dispense the tissues. By removing the tear strip, the user creates a dispensing opening that allows the compressed tissues to expand, facilitating dispensing without ripping or tearing. Preferably removal of the tear strip creates a dispensing opening having a width of from about 25 to 50 mm and still more preferably from about 30 to about 40 mm. In addition, in a particularly preferred embodiment, removal of the tear strip creates a dispensing opening that is relatively long relative to the length of the carton such as, for example, from about 70 to 100 percent of the length of the carton and more preferably from about 80 to 90 percent of the length of the carton. Thus, the carton of the present disclosure provides dispensing comparable to non-compressed tissue containers, while providing tissues in a compressed or concentrated product form that requires less shelf space.

Figure 1:
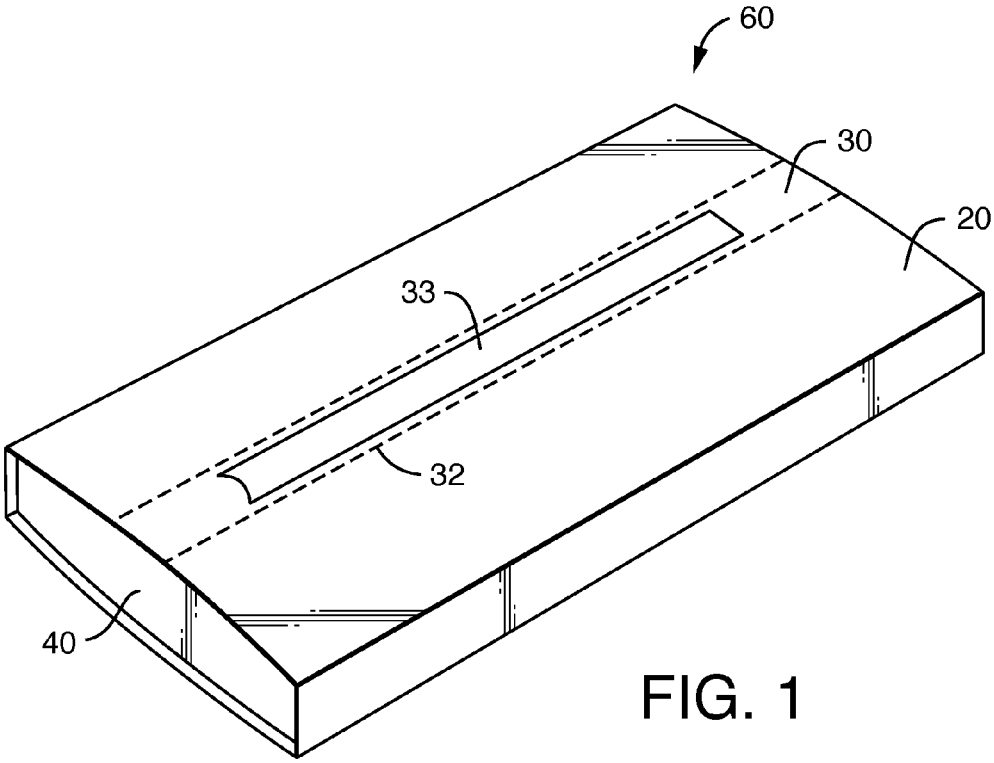
FIG. 1 illustrates a stack of compressed tissues wrapped in a releasable restraining device according to one embodiment of the present disclosure.

Now with reference to FIG. 1 which illustrates one embodiment of an overwrapped stack of compressed tissues. The film overwrap package 20, in a preferred embodiment, is a sheet of medium density polyethylene material; however, the overwrap package may be constructed of any sheet material having a low coefficient of friction, which allows the compressed tissues to be dispensed without tearing. For example, the material may be paper, polyethylene, polyester, polypropylene, polyvinyl chloride, polyamide, acetate, cellophane, rubber, elastomeric materials, or metal foils, amongst other suitable alternatives. The overwrap material can be a single layer, or a multilayer laminate of the above materials. Preferably the overwrap material is relatively thin, for example, having a thickness from about 0.1 to about 3 mm and even more preferably from about 0.3 to about 1 mm.

Figure 2:
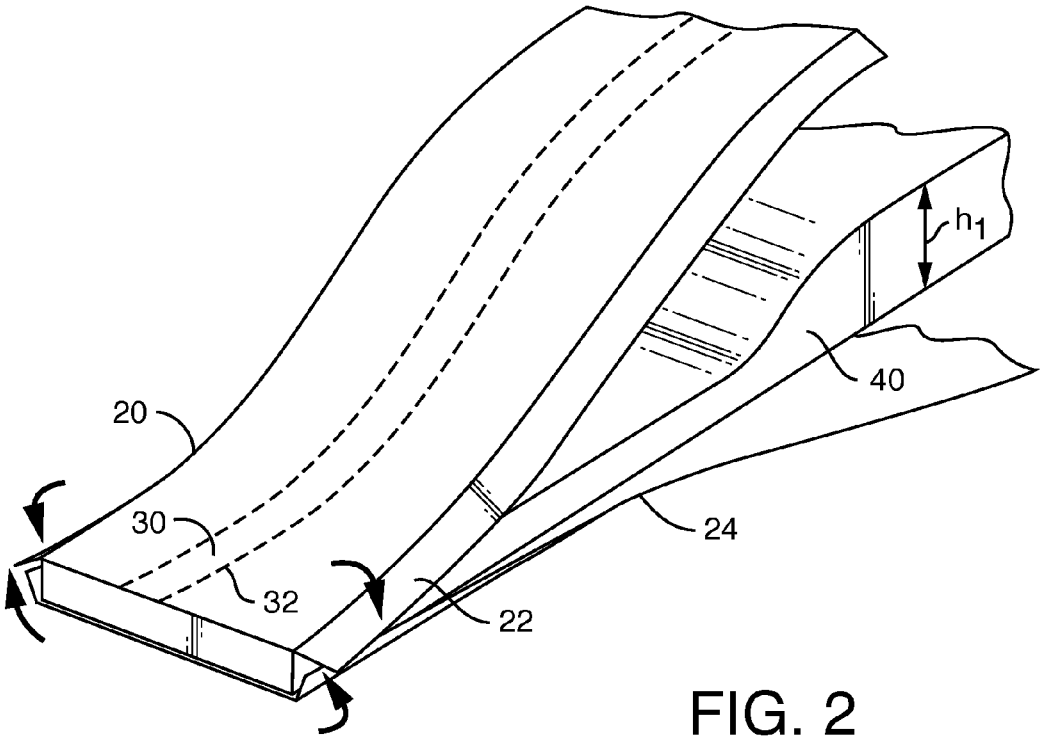
FIG. 2 illustrates one embodiment of manufacturing a compressed stack of tissues.

As shown in FIG. 2, the overwrap 20 is formed by overlapping a first longitudinal edge 22 of a first sheet of polyethylene material over a second longitudinal edge 24 of a second sheet of polyethylene material. Then, the overlapped region is fused by a conventional hot element heating means (not shown) to form a sealed side seam. The process is repeated on the opposing side to create a second sealed side seam. The clip, or stack, of facial tissues 40, illustratively a stack of from about 50 to about 100 multi-ply sheets, is inserted between the two sheets of material and compressed as the side seams are sealed. For example, the clip is centered within the two sheets of polyethylene material as shown; then the longitudinal edges of the material are folded over, mated and sealed by conventional means, forming an overwrapped compressed clip of tissues.

In other embodiments the overwrap may be formed from a single sheet of material, in which instance, the clip of facial tissues is centered on top of the sheet of material and compressed as the two edges of the sheet are folded together to form the overwrap. The two edges of the sheet material are folded over, mated and sealed by conventional means along the edges to form an overwrapped compressed clip of tissues.

Although the above fore mentioned package forming steps are described as a manual procedure, the entire package operation can be formed using conventional automatic wrapping equipment. If such equipment is used, the perforated lines 32 are normally performed prior to forming the overwrap.

In one embodiment the tear strip is formed by at least one line of weakness, such as score lines, perforations, laser scoring, or other lines of weakness, along the upper face of the overwrap. In a particularly preferred embodiment a pair of perforation lines 32, best seen in FIG. 2, of a chosen length are made on the upper surface of overwrap 20 such that the perforations can be broken to form a dispensing opening. Preferably the pair of perforations 32 are spaced apart from about 10 to about 40 mm and more preferably from about 15 to about 25 mm and still more preferably from about 18 to 20 mm. When the perforations 32 are broken and the tear strip 30 removed, the compressive overwrap 20 opens to form a dispensing opening 37 (best seen in FIGS. 7 and 9).

In other embodiments the tear strip is material applied to the overwrap so that pulling of the strip away from the overwrap causes the overwrap to separate proximate to the point at which the strip is attached, thus opening the compressed stack of tissues. Accordingly, the tear strip may comprise a strip of material, such as a plastic, attached to the upper surface of the overwrap, preferably adjacent to a sealed edge of the overwrap so that pulling of the strip away from the overwrap causes the overwrap to separate proximate to and along the heat seal line thus opening the overwrap.

One particularly preferred embodiment of the film overwrap package 20, which contains a clip of about 90 multi-ply facial tissues, is illustratively about 210 mm long, 35 mm high and 115 mm wide. The tear strip is defined by a pair of perforated lines 32 centered lengthwise on the upper face of the package 20 and extending from about 80 to about 100 percent of the length of the package 20. Illustratively, the length of the perforations may be equal to the length of the package, for example, about 210 mm long. Preferably, the tissues are compressed by the overwrap such that there is little or no space between the upper most tissue and the overwrap material.

With further reference to FIG. 2, the height of the uncompressed tissue stack ($h_1$) and the height of the compressed tissue stack ($h_2$) may vary depending upon the number of sheets within the stack, the caliper of the individual sheets and the nature of the folding of the sheets. In general, the height of the compressed tissue stack ($h_2$) will be from about 35 to about 80 percent of the uncompressed tissue stack ($h_1$), more specifically from about 45 to about 70 percent of $h_1$, and still more specifically from about 55 to about 60 percent of $h_1$. In the compressed state, $h_2$ will be approximately equal to the height of the carton (H), for example from about 90 to 120 percent of H. Suitably, $h_2$ is from about 95 to about 115 percent of the height H, more specifically from about 100 to about 105 percent of H.

Figure 3:
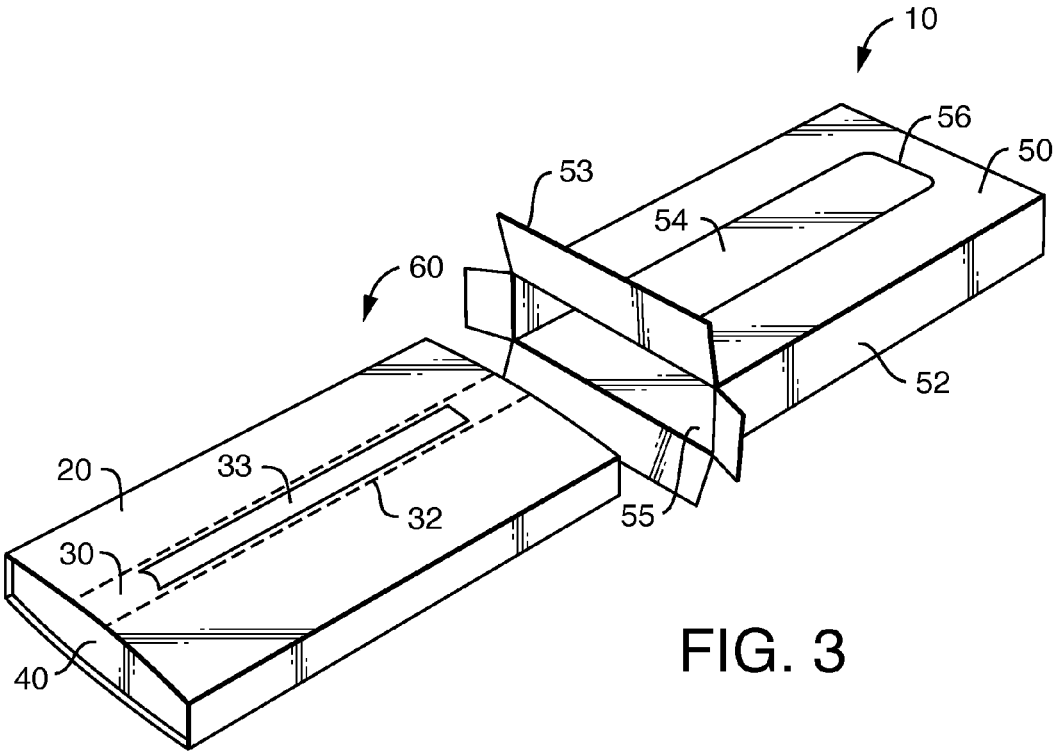
FIG. 3 illustrates a stack of compressed tissues wrapped in a releasable restraining device and a carton for dispensing the same according to one embodiment of the present disclosure.

As illustrated in FIG. 3, the overwrapped package 20 of compressed tissues is loaded into a tissue carton 10. As shown in FIG. 3, the carton 10 comprises a top panel 50, first 52 and second (not shown) sidewalls, opposing first 53 and second end panels (represented at 58 in FIG. 4), a bottom panel 55, and a removable surfboard 54. The surfboard 54 may be present on the top panel 50 (such as represented by the rectangular line of weakness in FIG. 3) and preferably defines a carton opening through which a user may access the overwrapped tissues. Such surfboards are a common feature of current commercially available tissue cartons. In certain embodiments, discussed further below, to further facilitate opening of the overwrapped package, the surfboard may be attached to the tear strip such that when the surfboard is removed by a user the tear strip is also removed. In a particularly preferred embodiment the surfboard 54 may also comprise a finger tab 57 (shown in FIG. 4) to facilitate removal.

The carton may be constructed from any rigid material, for example, cardboard, carton stock, paper board, polypropylene, polyethylene, polystyrene, ABS plastic, plastic, metal, wood, and glass amongst other suitable alternatives.

Figure 4:
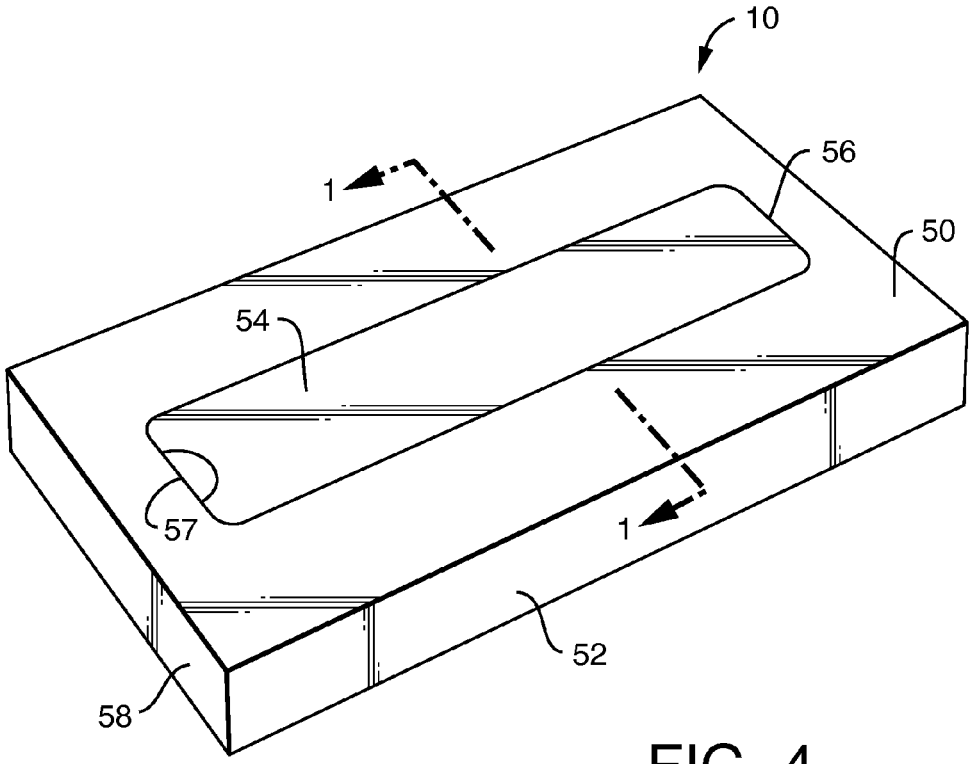
FIG. 4 illustrates a tissue carton according to another embodiment of the present disclosure.
Figure 5:
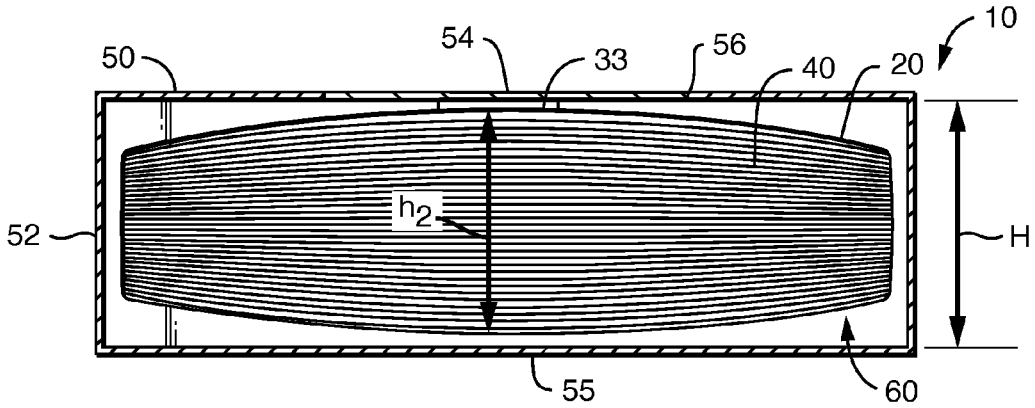
FIG. 5 illustrates a cross-section of the embodiment of FIG. 4 taken at line 1-1.

With reference to FIG. 5, which is a cross-section of the carton of FIG. 4 along line 1, the stack of compressed stack tissues 40 is constrained within the overwrap 20, which prevents the compressed stack from expanding. Preferably, the height of the carton (H) is equal to, or slightly less than, the compressed height ($h_2$) of the tissue stack. The height of the carton (H) is measured between the inside surface of the top face of the carton and the inside surface of the opposing bottom face of the carton. For example, $h_2$ is from about 90 to about 120 percent of the height H, more specifically from about 95 to about 110 percent of H. In a particularly preferred embodiment adhesive 33 may be disposed between the tear strip 30 and the surfboard 54, so that when a user removes the surfboard 54 the tear strip 30 is also removed.

Figure 6:
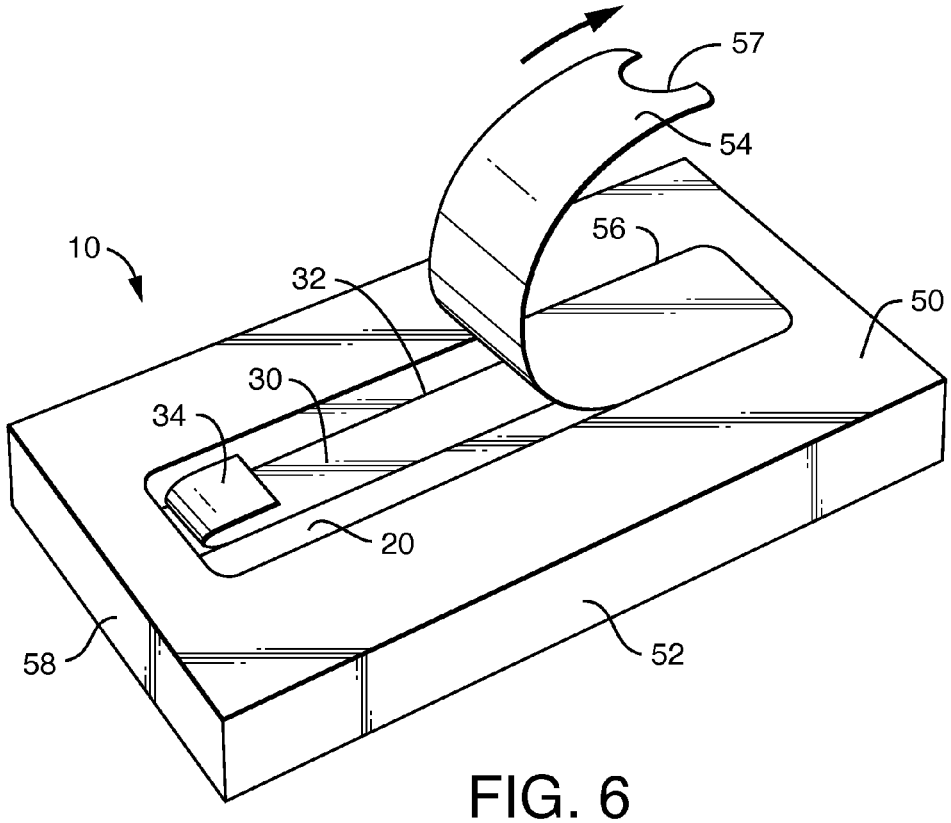
FIG. 6 illustrates a view of a carton according to one embodiment of the present disclosure after the carton has been partially opened by a user.

The operation of the carton 10 will now be discussed with reference to FIGS. 6 and 7. In one embodiment the carton 10 is opened by removing the surfboard 54 which is defined by a line of weakness 56, such as a line of perforations or the like. Preferably the surfboard 54 has a finger tab 57 to facilitate removal. Removal of the surfboard 54 forms a carton opening 51 and exposes the overwrapped package 20 of compressed tissues, which may contain, in a preferred embodiment, from about 50 to about 200 tissues. The user opens the overwrapped package 20 by grasping the finger tab 34 and removing the tear strip 30, which separates along the lines of weakness 32 to form a dispensing opening in the overwrap through which tissues may be dispensed.

Figure 7:
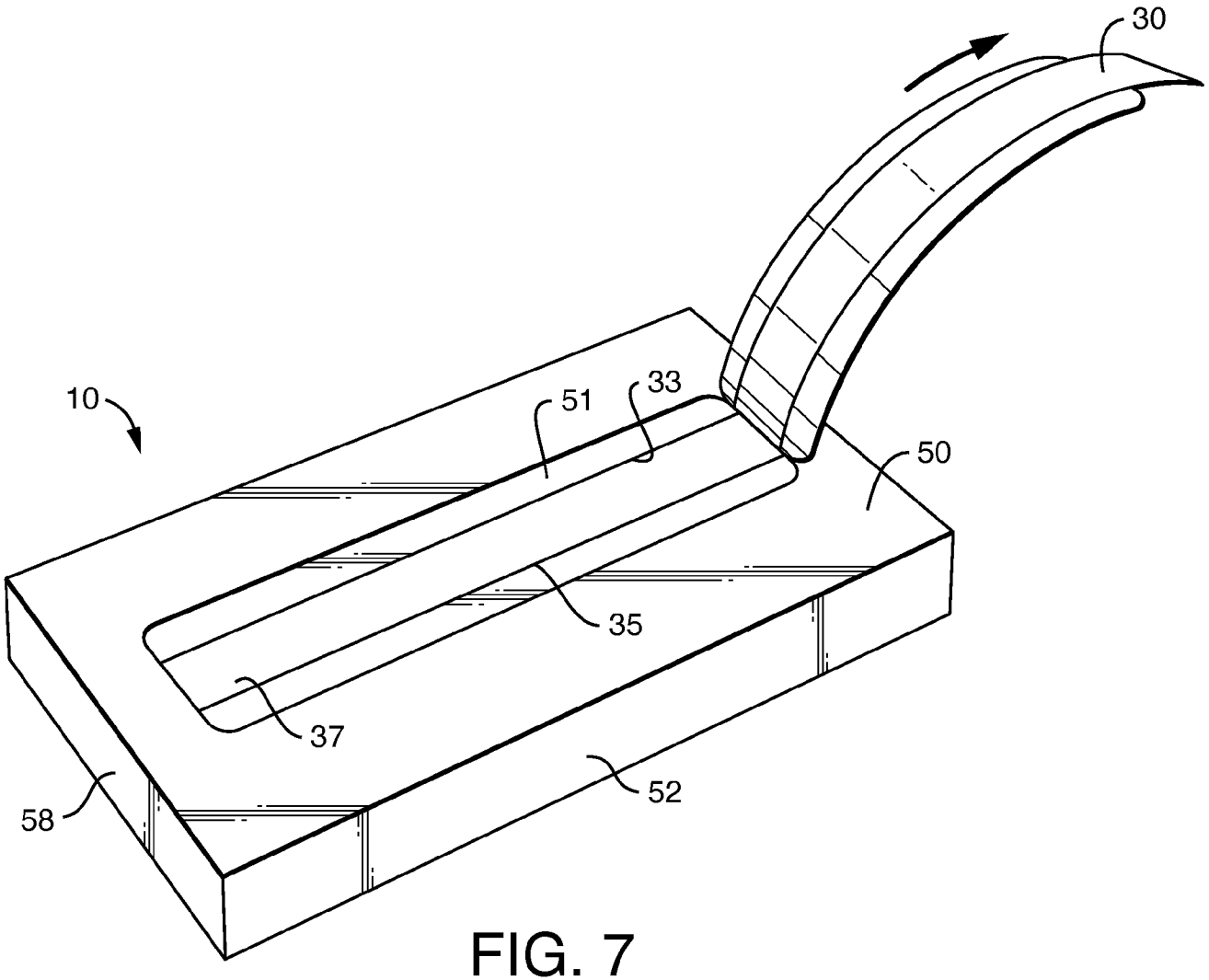
FIG. 7 illustrates a view of a carton according to another embodiment of the present disclosure after the carton has been partially opened by a user.

In another embodiment the carton 10 may be prepared for dispensing, as illustrated in FIG. 7, by removing the surfboard 54 which is attached to the tear strip 30. Preferably the tear strip has a finger tab which extends beyond the end of the surfboard, which allows the user to grasp the tear strip while removing it with the surfboard. Removal of the surfboard 54 removes the tear strip and exposes the stack of tissues 40, which may contain a tissue count of from about 50 to about 200 tissues.

Figure 8:
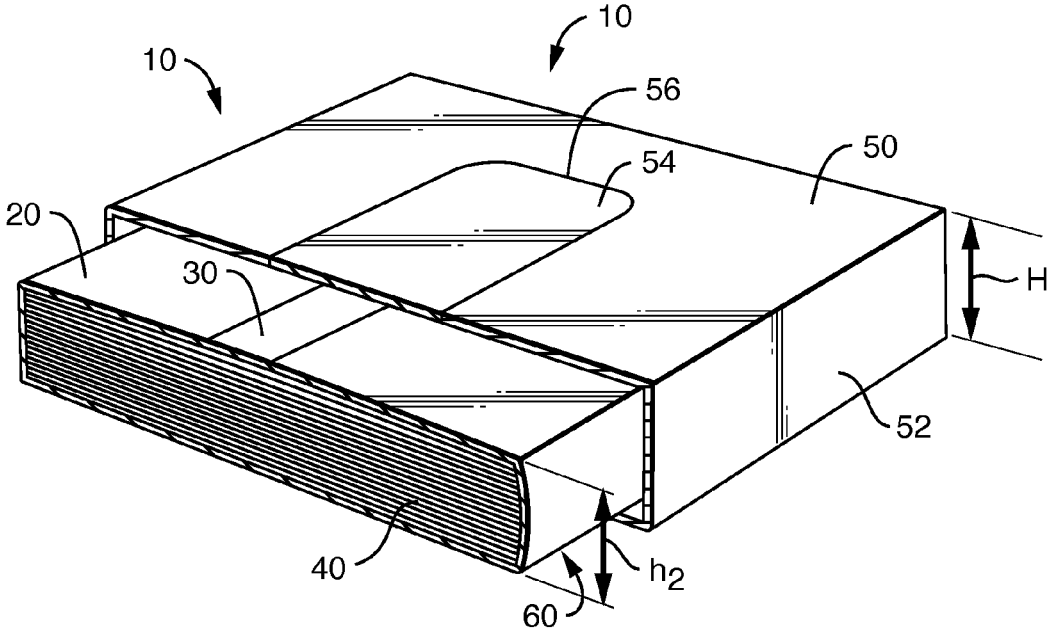
FIG. 8 illustrates a cross-sectional view of yet another embodiment of a tissue carton according to the present disclosure.

FIG. 8 schematically illustrates the product of FIG. 4 before the user has removed the surfboard 54 and prepared the carton 10 for dispensing. Prior to dispensing, the compressed stack of tissues 40 is constrained by an overwrap 20, forming a wrapped compressed clip of tissues 60. As discussed previously, a tear strip 30, defined by a pair of spaced apart perforations 32, is disposed on the upper surface of the overwrap 20. The height of the compressed stack of tissues ($h_2$) is preferably relative to the height of the carton (H), for example, about 90 to about 120 percent of the height H, more specifically from about 95 to about 110 percent of H.

Figure 9:
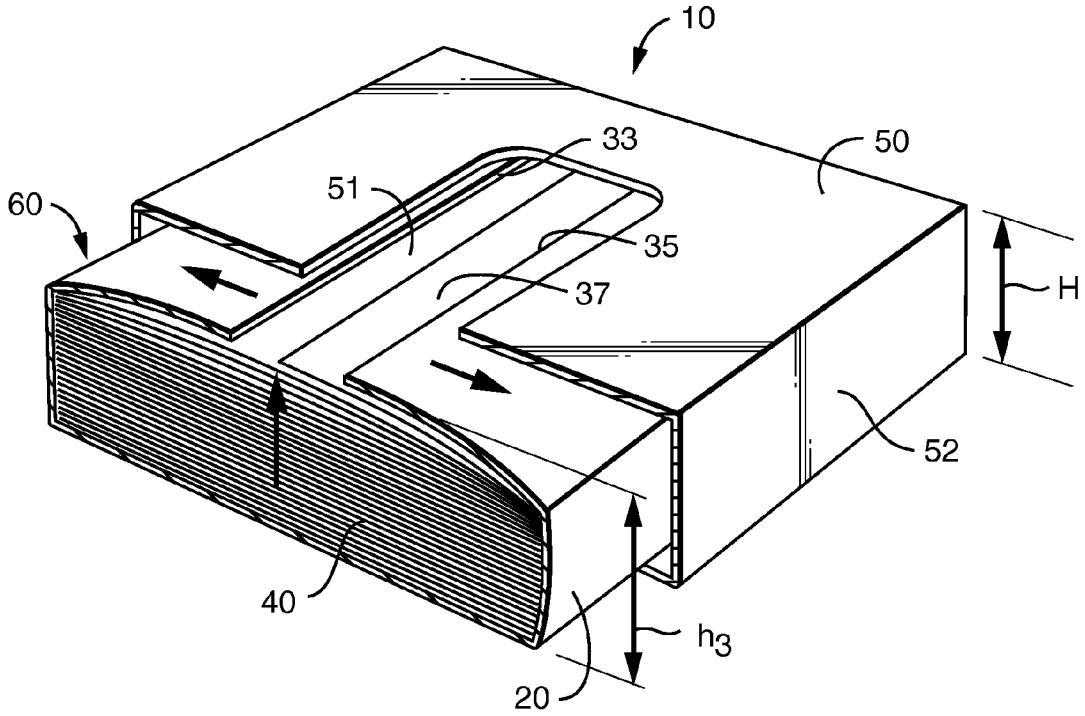
FIG. 9 illustrates a cross-sectional view of still another embodiment of a tissue carton according to the present disclosure.

After the user has removed the surfboard 54 and the tear strip 30, the compressed stack of tissues 40 expands vertically to an uncompressed dispensing height ($h_3$). As shown in FIG. 9 the carton and overwrap are designed to allow the stack of tissues 40 to expand, easing dispensing.

With further reference to FIG. 9, when the tear strip is removed a pair of opposing edges 33, 35 are formed, which define a dispensing opening 37. Each tissue is pulled through the dispensing opening 37 by a user. Formation of the dispensing opening 37 permits the compressed stack of tissues to decompress, forming air gaps between adjacent sheets, particularly amongst the upper most sheets in the stack. During the initial dispensing of the tissues the air gaps prevents the upper portion of the overwrap 20 and the top panel of the carton 50 from adding any undesirable resistive force against the surface of the tissues being withdrawn from the top portion of the clip. Further, in a particularly preferred embodiment the first and second edges 33, 35 extends beyond the perforated edges of the opening 56 so as to prevent scraping or abrading tissues as each tissue is removed from the package.

The formation of a dispensing opening 37 effectively provides an area for the compressed stack of tissues to expand into when the surfboard 54 and tear strip 30 are removed. In a particularly preferred embodiment, upon release of the surfboard by a user, the compressed tissue stack expands from a compressed height ($h_2$) to a dispensing height ($h_3$), where the dispensing height ($h_3$) is from about 100 percent to about 120 percent greater than $h_2$. As used herein, the dispensing height ($h_3$) refers to the maximum height of the tissue stack measured after the surfboard is removed and before the first tissue is dispensed. In should be noted however, that while it is preferable that the stack height expand with the release of the package compression, it is not a requirement of this invention. Therefore, in certain embodiments $h_2$ may equal $h_3$.

In those embodiments where the dispensing height ($h_3$) is greater than the height of the compressed tissue stack ($h_2$), the carton may be configured to permit maximum expansion of the stack. For example, in one preferred embodiment the opening formed by removal of the surfboard comprises at least about 30 percent of the total surface area of the top panel 50, and still more preferably at least about 35 percent and still more preferably at least about 40 percent. Accordingly, in certain embodiments the width (w) of the carton opening may be from about 30 to about 80 mm and the length (l) may be from about 150 to about 200 mm, while the width (W) of the top panel 50 may be from about 90 to about 140 mm and the length (L) may be from about 190 to about 240 mm. Preferably, immediately upon opening of the carton and overwrap by the user, the width of the carton opening 51 is greater than the width of the dispensing opening 37. In use however, the width of the dispensing opening may continue to widen as tissues are dispensed such that it becomes as wide as, or wider, than the width of the carton opening.

As further illustrated in FIG. 8, tissues are dispensed through the dispensing opening 37. The dispensing opening 37 is initially defined by the tear strip. Upon removal of the tear strip, an opening in the overwrap is formed, through which tissues are dispensed. In a preferred embodiment the shape of the dispensing opening 37 is optimized to facilitate dispensing of the compressed tissues. Accordingly, in a preferred embodiment the dispensing opening 37 has a width that is about 50 to 150 percent, and more preferably about 75 to 125 percent, greater than the width of the tear strip. In other embodiments the width of the dispensing opening 37 is from about 30 to about 50 mm and more preferably from about 35 to about 45 mm. The dispensing opening may extend the length of the overwrap and in certain instances may be about equal to the length of the carton. In a particularly preferred embodiment the length of the dispensing opening 37 is equal to the length of the surfboard, such as from about 150 to about 200 mm and more preferably from about 160 to about 185 mm.

It must be noted that while the general shape of the carton 10 can be rectangular as shown; other shapes can also be employed, such as hexagonal, triangular, square and the like. Similarly, while the general shape of the top panel 50 and dispensing opening 37 is illustrated as rectangular, other shapes can also be employed, such as square, oval, and the like.

Accordingly, the top and bottom sidewalls of the carton can be any shape or size. Suitable shapes can include triangular, square, rectangular, pentagon, hexagon, octagon, oval, circular, star shaped or fluted. The overall size of the carton and the shape of the sidewalls can be designed as needed to properly dispense the sheet material placed within the carton. The size and shape of the carton can be influenced by the size of the sheet material being dispensed, how the sheets are folded prior to placement in the dispenser, the number of sheets placed into the dispenser, the orientation of the stack, configuration of the stack within the dispenser, and the characteristics of the material being dispensed. Often more than one acceptable shape will work to properly dispense the sheet material.

In one embodiment, the top panel and bottom panel comprised rectangles having an approximate size of 21.5 cm long by 11.5 cm wide. The sidewalls in this embodiment comprised two pairs of opposing panels attached to the top and bottom panels as illustrated in FIG. 4. The pair of opposing sidewalls have a height of approximately 3.5 cm and a length of approximately 21.5 cm. The other pair of opposing sidewalls, also referred to as end panels, comprise panels having a height of approximately 3.5 cm and a length of approximately 11.5 cm. Such a size is useful for dispensing standard size facial tissue sheets in a flat carton when folded into a stack and placed within the dispenser.

The stack of tissues may be interfolded, prefolded interfolded, or non-interfolded. As used herein, the phrase "prefolded interfolded" or "interfolded" tissues means that the tissues are folded and interleaved with neighboring tissues immediately above and/or below in the clip of tissues. The tissues can be interleaved by any suitable means, including the use of an interfolder as employed in the papermaking arts. If an interfolder is used, consecutive tissues may be attached to each other at perforation lines. In such cases, the unperforated segments of the perforation lines should be sufficiently weak to permit the consecutive tissues to separate from each other upon removal from the carton. This can be controlled by the degree of perforation of the tissue sheet. Tissues that may be employed in a non-interfolded clip which are not interleaved with neighboring tissues are releasably attached to neighboring tissues so that upon dispensing one tissue, the next adjacent tissue is ready for dispensing. Particularly preferred folding patterns include interfolding patterns that provide somewhat less friction, which tend to avoid tearing of the tissue when extracted from the container.

Webs or sheets may be folded in a stacked arrangement. Each web or sheet, when laid flat, may assume a square or rectangular shape, in many instances. Many different folds may be employed, and several embodiments of the invention are shown in the attached Figures. Folds are defined as first folds, second folds, third folds, and the like by reference to their respective position on the sheet. That is, a sheet or web having four folds, for example, typically would have a first fold, second fold, third fold, and fourth fold in that order, respectively, as when moving from one edge of the sheet to the opposite edge of that sheet.

A folded sheet, for example, would have four panels or folds and three creases. One crease appears at the junction of each fold. For example, a first crease is at the junction of the first fold and a second fold, as will be further described below. A bifolded sheet, for example, would have two folded panels and one crease, while a trifolded sheet would have three folded panels and two creases.

It should be understood that the term "web," as used herein, is meant to include a sheet material made of one or more plies of material so that a multiple-ply sheet material is considered to be a "web" of sheet material, regardless of the number of plies.

As shown in FIG. 2, the stack 40 of folded tissues has an initial non-compressed height ($h_1$). The stack is subjected to a compressive force. The compressive force compresses the stack 40, reducing its height to a compressed height ($h_2$). Preferably the compressive force is controlled so that when the user opens the carton, the stack of folded tissues is not compressed or not significantly compressed to the extent dispensing of the tissues is adversely affected.

In certain embodiments the non-compressed height ($h_1$) of the stack may be, for example, from about 45 to about 95 mm. The compressive force preferably reduces the height of the stack by about 30 to about 70 percent, such that the compressed height ($h_2$) is from about from about 25 to about 50 cm.

EXAMPLE

In order to further illustrate the invention, a tissue carton, similar to the carton illustrated in FIG. 3, having a top panel, first and second sidewalls, opposing first and second end panels, a bottom panel, a carton opening, and a surfboard covering a portion of the carton opening was constructed. The dimensions of the carton were as follows: height (H) 35 mm, length (L) 215 mm, width (W) 115 mm, surfboard length (l) 175 mm, and surfboard width (w) 55 mm. A comparison of the dimensions of other tissue cartons is found in the table below.

TABLE 1

| Product | Sheet Count | Total Sheet Area ($cm^2$) | Sheet Plies | Carton Volume ($cm^3$) |
|---|---|---|---|---|
| Example 1 | 88 | 210276 | 3 | 865 |
| Kleenex ™ Cube | 56 | 70560 | 3 | 1344 |
| Kleenex ™ Original | 88 | 110880 | 3 | 1825 |
| Kleenex ™ Mansize | 100 | 159300 | 2 | 2746 |
| Sainsbury's Basics Facial Tissue | 150 | 126000 | 2 | 1912 |
| Morrison's Regular | 150 | 126000 | 2 | 1765 |
| Morrison's Mansize | 56 | 128967 | 3 | 2417 |
| Morrison's The Best Family Tissue | 90 | 151200 | 4 | 2188 |
| Puffs ® Ultra Soft & Strong | 124 | 109874 | 2 | 2511 |
| Great Value ™ Facial Tissue | 110 | 97469 | 2 | 1890 |

The tissue carton was loaded with a compressed stack of 88 sheets of three ply tissue. The total tissue area (i.e., the area of a single tissue ply, multiplied by the number of plies, multiplied by the number of sheets) was 210276 $cm^2$. The 88 sheets had an uncompressed height ($h_1$) of 6.5 cm. The stack was compressed by 43 percent to a height ($h_2$) of 3.7 cm. The compressed tissues were packaged in an overwrap constructed of polyethylene. The overwrapped clip of tissues measured 114 mm wide and 209 mm long and had a tear strip, defined by a pair of parallel spaced apart perforations on its upper surface. The perforations were 209 mm long and were spaced apart by 20 mm.

The surfboard was removed from the top of the dispensing carton and the tear strip was removed from the compressed clip in order to dispense the tissues. Upon removal of the tear strip an opening measuring 40 mm was formed. Despite the stack of tissues being compressed, dispensing was achieved without tearing the tissues. Prior to dispensing the first tissue, the stack of tissues rose to a height of 41 cm. Subsequent tissues were removed from the carton without incident.

A carton volume reduction of approximately 53 percent was achieved compared to traditional cartons used to dispense similar sized non-compressed tissue. Cardboard packaging required was reduced by 28 percent. As a result, the cost savings associated with the material and shipping costs for such a product would be significant.

It will be appreciated that the foregoing example, given for purposes of illustration, is not to be construed as limiting the scope of the invention, which is defined by the following claims and all equivalents thereto.

We claim:

1. A tissue carton for dispensing a compressed stack of tissues comprising:

a. a top panel;

b. a pair of opposing side panels;

c. a pair of opposing end panels;

d. a bottom panel;

e. a removable surfboard disposed on the top panel, the surfboard defining a carton opening;

f. an overwrapped stack of compressed tissues having a compressed height ($h_2$) disposed within the carton; and g. a tear strip disposed on the overwrapped stack of compressed tissues and defining a dispensing opening, the tear strip having a length from about 90 to about 100 percent of the length of the top panel.; wherein removal of the tear strip forms a dispensing opening and causes the compressed stack of tissues to expand to an uncompressed height ($h_3$).

2. The carton of claim 1 wherein the tear strip is formed by at least one line of weakness.

3. The carton of claim 1 wherein the tear strip is formed by a pair of parallel spaced apart lines of weakness, the lines of weakness defining opposing edges of the dispensing opening.

4. The carton of claim 3 wherein the pair of spaced apart lines are from about 15 to about 25 mm apart.

5. The carton of claim 1 wherein removal of the tear strip further forms a tissue dispensing opening having a width from about 30 to about 45 mm.

6. The tissue dispenser of claim 1 wherein the tear strip further comprises a finger tab.

7. The tissue dispenser of claim 1 wherein the surfboard has a width from about 30 about 80 mm.

8. The tissue product of claim 1 wherein $h_2$ is from about 30 to about 70 percent less than an identical stack of tissues in an uncompressed height ($h_1$).

9. The tissue dispenser of claim 1 further comprising an adhesive disposed between the removable surfboard and the tear strip.

* * * * *